US010529276B2

(12) United States Patent
Kim et al.

(10) Patent No.: US 10,529,276 B2
(45) Date of Patent: Jan. 7, 2020

(54) APPARATUS, SYSTEMS, AND METHODS FOR PREVENTING DISPLAY FLICKER

(71) Applicant: FACEBOOK TECHNOLOGIES, LLC, Menlo Park, CA (US)

(72) Inventors: Cheonhong Kim, Mountain View, CA (US); Evan M. Richards, Fremont, CA (US)

(73) Assignee: Facebook Technologies, LLC, Menlo Park, CA (US)

( * ) Notice: Subject to any disclaimer, the term of this patent is extended or adjusted under 35 U.S.C. 154(b) by 184 days.

(21) Appl. No.: 15/863,664

(22) Filed: Jan. 5, 2018

(65) Prior Publication Data

US 2019/0213950 A1 Jul. 11, 2019

(51) Int. Cl.

| | |
|---|---|
| ***G09G 3/3225*** | (2016.01) |
| ***G09G 3/34*** | (2006.01) |
| ***G09G 3/36*** | (2006.01) |

(52) U.S. Cl.

CPC ..... *G09G 3/3225* (2013.01); *G09G 3/3406* (2013.01); *G09G 3/3648* (2013.01); *G09G 2310/08* (2013.01); *G09G 2320/0247* (2013.01); *G09G 2320/064* (2013.01)

(58) Field of Classification Search

CPC .. G09G 3/3225; G09G 3/3648; G09G 3/3406; G09G 2320/0247; G09G 2320/064; G09G 2310/08

See application file for complete search history.

(56) References Cited

U.S. PATENT DOCUMENTS

| | | | | |
|---|---|---|---|---|
| 9,385,169 | B2 * | 7/2016 | Chaji | H01L 27/3227 |
| 2016/0086574 | A1 * | 3/2016 | Buckley | G09G 5/10 345/690 |
| 2016/0267715 | A1 | 9/2016 | Patel | |
| 2017/0249892 | A1 * | 8/2017 | Jo | G09G 3/2092 |
| 2017/0277000 | A1 | 9/2017 | Shi | |
| 2017/0287408 | A1 | 10/2017 | Shi | |
| 2017/0287409 | A1 | 10/2017 | Richards | |
| 2017/0308161 | A1 | 10/2017 | Richards | |
| 2018/0005591 | A1 * | 1/2018 | Yoshiga | G09G 3/3607 |

* cited by examiner

*Primary Examiner* — Andrew Sasinowski
(74) *Attorney, Agent, or Firm* — FisherBroyles, LLP

(57) ABSTRACT

A display device may include (1) a display panel with at least one pixel element and (2) a display driver configured to (a) transition the pixel element to a first state, (b) illuminate, after the pixel element transitions to the first state, the pixel element for a first period of illumination, (c) refrain, after the first period of illumination, from illuminating the pixel element for a period of no illumination, (d) illuminate, while the pixel element is still in the first state and after the period of no illumination, the pixel element for a second period of illumination to at least reduce perceived flickering of the display panel, and (e) transition, after the second period of illumination, the pixel element from the first state to a second state. Various other apparatus, systems, and methods are also disclosed.

20 Claims, 11 Drawing Sheets

APPARATUS, SYSTEMS, AND METHODS FOR PREVENTING DISPLAY FLICKER

BACKGROUND

Virtual reality (VR) and augmented reality (AR) headsets are gaining in popularity for use in a growing number of activities. Such headsets may integrate visual information into a user's field of view to enhance their surroundings or allow them to step into immersive three-dimensional environments. While virtual reality and augmented reality headsets are often utilized for gaming and other entertainment purposes, they are also commonly employed for purposes outside of recreation—for example, governments may use them for military training simulations, doctors may use them to practice surgery, and engineers may use them as visualization aids. Virtual and augmented reality systems are also increasingly recognized for their utility in facilitating interpersonal interactions between individuals in a variety of contexts.

The displays utilized in virtual and augmented reality headsets typically need to have a small profile while also displaying high-quality, high-resolution images. For virtual reality or augmented reality applications, frames (or still images) are generally generated according to a user's movement, and slow frame rates may be noticed as latency or lag. As a result, many virtual reality or augmented reality applications are ideally viewed at high frame rates. In conventional virtual and augmented reality headsets, a user's field of view typically exceeds 80 degrees, and low persistence (i.e., the time a frame is illuminated) is often used to prevent motion blur. Illumination times for conventional displays have generally been tied to frame rates, with one illumination period occurring for each frame.

In some situations, lower frame rates for the displays utilized in virtual and augmented reality headsets may be desirable since lower frame rates generally require less compute, power, and bandwidth resources. Unfortunately, if virtual and augmented reality headsets use conventional illumination methods, lower frame rates may cause noticeable display flickering since flickering may be more easily noticed in the peripheral of human vision. The instant disclosure, therefore, identifies and addresses a need for apparatus, systems, and methods that reduce and/or prevent display flicker, especially for display panels used in virtual and augmented reality headsets.

SUMMARY

As will be described in greater detail below, the instant disclosure describes various apparatus, systems, and methods for preventing display flicker. A display device may include (1) a display panel with at least one pixel element and (2) a display driver configured to (a) transition the at least one pixel element to a first state, (b) illuminate, after the at least one pixel element transitions to the first state, the at least one pixel element for a first period of illumination, (c) refrain, after the first period of illumination, from illuminating the at least one pixel element for a period of no illumination, (d) illuminate, while the at least one pixel element is still in the first state and after the period of no illumination, the at least one pixel element for a second period of illumination to at least reduce perceived flickering of the display panel, and (e) transition, after the second period of illumination, the at least one pixel element from the first state to a second state. In some examples, the at least one pixel element may include a row of pixel elements of the display panel.

In some examples, the display driver may be further configured to (1) refrain, after the second period of illumination, from illuminating the at least one pixel element for one or more additional periods of no illumination and (2) illuminate, while the at least one pixel element is still in the first state and after each of the one or more additional periods of no illumination, the at least one pixel element for an additional period of illumination. In some examples, the at least one pixel element may be in an outer portion of the display panel, the display panel may further include at least one additional pixel element that may be in an inner portion of the display panel, and the display driver may be further configured to (1) transition the at least one additional pixel element to a third state, (2) transition, after a frame period, the at least one additional pixel element from the third state to a fourth state, and (3) illuminate the at least one additional pixel element only once during the frame period.

In some examples, the display driver may be configured to transition the at least one pixel element from the first state to the second state at a frame period after transitioning the at least one pixel element to the first state and may be configured to illuminate the at least one pixel element for the second period of illumination at substantially one half of the frame period after the start of the first period of illumination. In some examples, the display driver may be configured to transition the at least one pixel element from the first state to the second state at a frame period after transitioning the at least one pixel element to the first state, the first period of illumination may be less than twenty percent of the frame period, and the second period of illumination may be less than twenty percent of the frame period. In some examples, the first period of illumination and the second period of illumination may be substantially the same length. In some examples, the display panel may be an organic light-emitting diode panel. In other examples, the display panel may include a liquid crystal display panel. In at least one example, the display device may further include a backlight unit configured to perform rolling illumination.

In some examples, the display driver may simultaneously illuminate all pixel elements of the display panel for the first period of illumination and/or may simultaneously illuminate all pixel elements of the display panel for the second period of illumination. In some examples, the display panel may further include at least one additional pixel element, and the display driver may be further configured to (1) transition, during the first period of illumination of the at least one pixel element, the at least one additional pixel element to a third state, (2) illuminate, after the at least one additional pixel element transitions to the third state, the at least one additional pixel element for a third period of illumination, (3) refrain, after the third period of illumination, from illuminating the at least one additional pixel element for an additional period of no illumination, (4) illuminate, while the at least one additional pixel element is still in the third state and after the additional period of no illumination, the at least one additional pixel element for a fourth period of illumination to at least reduce perceived flickering of the display panel, and (5) transition, after the fourth period of illumination, the at least one additional pixel element from the third state to a fourth state.

In some examples, the display device may be a head-mounted display, the head-mounted display may include a display housing configured to be mounted on a user's head, and the display panel and the display driver may be disposed within the display housing. In at least one example, the head-mounted display may further include (1) a lens for the user's eye disposed within the display housing, (2) an additional lens for the user's other eye disposed within the display housing, and (3) an additional display panel with at least one additional pixel element disposed within the display housing. In certain examples, the display panel may be configured to provide images to the user's eye through the lens, the additional display panel may be configured to provide additional images to the user's other eye through the additional lens, and the display driver may be further configured to (1) transition the at least one additional pixel element to a third state, (2) illuminate, after the at least one additional pixel element transitions to the third state, the at least one additional pixel element for a third period of illumination, (3) refrain, after the third period of illumination, from illuminating the at least one additional pixel element for an additional period of no illumination, (4) illuminate, while the at least one additional pixel element is still in the third state and after the additional period of no illumination, the at least one additional pixel element for a fourth period of illumination to at least reduce perceived flickering of the additional display panel, and (5) transition, after the fourth period of illumination, the at least one additional pixel element from the third state to a fourth state.

In some examples, the display driver may transition the at least one pixel element to the first state by applying a first readout signal to the at least one pixel element and may transition the at least one pixel element to the second state by applying a second readout signal to the at least one pixel element. In these examples, the first readout signal may cause the at least one pixel element to take on the first state, and the second readout signal may cause the at least one pixel element to take on the second state.

A corresponding computer-implemented method may include (1) transitioning at least one pixel element of a display panel to a first state, (2) illuminating, after the at least one pixel element transitions to the first state, the at least one pixel element for a first period of illumination, (3) refraining, after the first period of illumination, from illuminating the at least one pixel element for a period of no illumination, (4) illuminating, while the at least one pixel element is still in the first state and after the period of no illumination, the at least one pixel element for a second period of illumination to at least reduce perceived flickering of the display panel, and (5) transitioning, after the second period of illumination, the at least one pixel element from the first state to a second state.

In some examples, a rolling-illumination method may be used to illuminate the at least one pixel element for the first period of illumination and the second period of illumination. In other examples, a global-illumination method may be used to illuminate the at least one pixel element for the first period of illumination and the second period of illumination. In at least one example, the step of transitioning the at least one pixel element to the first state may include applying a first readout signal to the at least one pixel element, and the step of transitioning the at least one pixel element to the second state may include applying a second readout signal to the at least one pixel element. In these examples, the first readout signal may cause the at least one pixel element to take on the first state, and the second readout signal may cause the at least one pixel element to take on the second state.

In some examples, the above-described method may be encoded as computer-readable instructions on a non-transitory computer-readable medium. For example, a computer-readable medium may include one or more computer-executable instructions that, when executed by at least one processor of a computing device, may cause the computing device to (1) transition at least one pixel element of a display panel to a first state, (2) illuminate, after the at least one pixel element transitions to the first state, the at least one pixel element for a first period of illumination, (3) refrain, after the first period of illumination, from illuminating the at least one pixel element for a period of no illumination, (4) illuminate, while the at least one pixel element is still in the first state and after the period of no illumination, the at least one pixel element for a second period of illumination to at least reduce perceived flickering of the display panel, and (5) transition, after the second period of illumination, the at least one pixel element from the first state to a second state.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
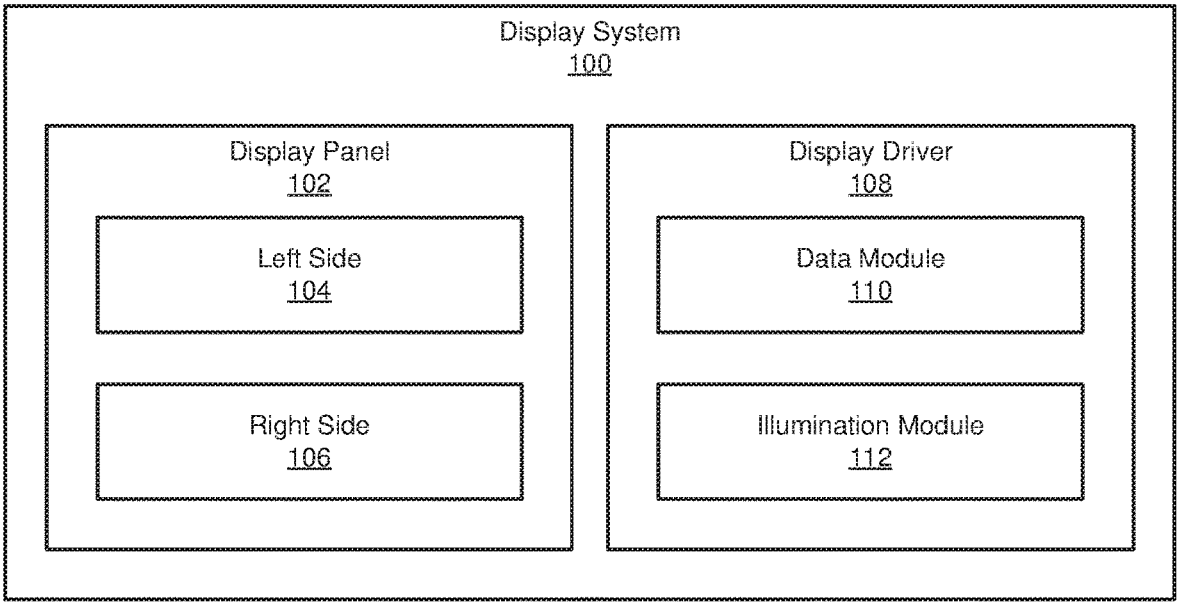
FIG. 1 is a block diagram of an exemplary display system in accordance with some embodiments.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure is generally directed to preventing display flicker. As will be explained in greater detail below, embodiments of the instant disclosure may prevent a viewer from perceiving display flicker by illuminating display panels at a sufficiently high rate regardless of the frame rate at which frames are received and displayed via the display panels. In some examples, multiple illumination periods or pulses may be used for each displayed frame to prevent flickering. By decoupling illumination rates from frame rates, embodiments of the instant disclosure may enable the use of lower frame rates for display systems where viewers may be more prone to perceiving display flicker (e.g., virtual and augmented reality headsets). Moreover, by enabling the use of lower frame rates for certain display systems, embodiments of the instant disclosure may reduce the cost of these systems since they may require less compute, power, and bandwidth resources.

The following will provide, with reference to FIGS. 1-4 and 10, examples of head-mounted display systems and devices. In addition, the discussion corresponding to FIGS. 5-9 and 11 will provide examples of methods for illuminating display panels to prevent display flicker.

FIG. 1 is a block diagram of an exemplary display system 100 configured to illuminate display panels in a way that prevents perceivable display flicker at lower frame rates. As illustrated in this figure, example display system 100 may include a display panel 102 and a display driver 108. Display screen 102 may be any suitable type of liquid crystal display (LCD) screen, such as a backlit LCD screen that modulates emitted light through an active matrix liquid crystal pixel array. In some embodiments, display panel 102 may be any other suitable type of display screen, such as, for example, an organic light-emitting diode (OLED) screen (e.g., an active-matrix OLED screen), a plasma screen, and/or any other suitable display screen. Light may be emitted from a display surface of display screen 102 such that images are visible to a user. As shown in FIG. 1, display panel 102 may include a left side 104 and a right side 106. Left side 104 and right side 106 may represent a left portion and a right portion of pixel elements of display panel 102, respectively. When incorporated in a head-mounted display system, left side 104 and right side 106 may represent the portion of display panel 102 that is visible to a user's left eye and right eye, respectively.

While not illustrated in FIG. 1, in some embodiments, display system 100 may include two or more display panels. For example, when incorporated in a head-mounted display system, display system 100 may include a left panel that is visible to a user's left eye and a right panel that is visible to a user's right eye. In these examples, display panel 102 may represent either the left panel or the right panel. In some embodiments, display system 100 may also include a backlight unit (BLU) for illuminating display panel 102. In some examples, the backlight unit may include a plurality of electrical components that generate light such as an array of light-emitting diodes, an electroluminescent panel, a cold cathode fluorescent lamp, a hot cathode fluorescent lamp, an external electrode fluorescent lamp, and/or an array of laser emitting diodes, without limitation. In some examples, the backlight unit may be capable of performing rolling illumination (e.g., the backlight unit may be capable of illuminating some rows of display panel 102 while also refraining from illumining other rows). In some examples, the backlight unit may be capable of scanning or rolling illumination of display panel 102 from one side of display panel 102 to the other.

Display driver 108 may include any suitable circuitry for driving pixel elements of display panel 102 and/or controlling illumination of display panel 102. For example, display driver 108 may include at least one display driver integrated circuit (IC). In some examples, display driver 108 may include timing controller (TCON) circuitry that receives commands and/or imaging data and generates horizontal and vertical timing signals for pixel elements (e.g., thin-film-transistors (TFTs)) of display panel 102 and/or timing signals for backlights. In some examples, display driver 108 may be mounted on an edge of a TFT substrate of display panel 102 and electrically connected to scan lines and data lines of display panel 102. As illustrated in FIG. 1, display driver 108 may include one or more modules for performing one or more tasks. As will be explained in greater detail below, display driver 108 may include a data module 110 and an illumination module 112. Although illustrated as separate elements, one or more of the modules in FIG. 1 may represent portions of a single module or application.

Figure 2:
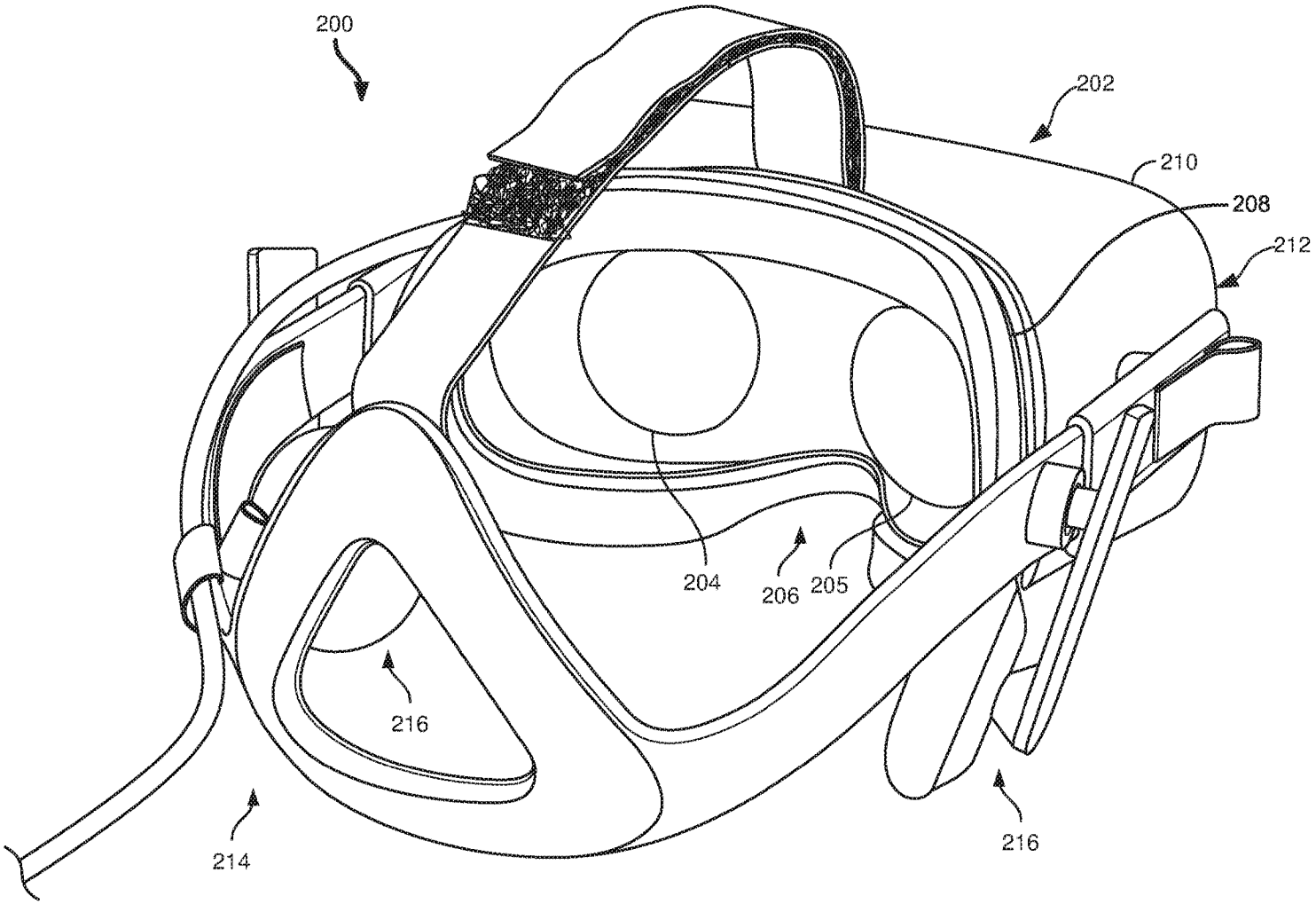
FIG. 2 is a perspective view of an exemplary head-mounted display system in accordance with some embodiments.

Example display system 100 in FIG. 1 may be implemented and/or configured in a variety of ways. For example, as shown in FIG. 2, all or a portion of example display system 100 may represent portions of example head-mounted display system 200. Additionally or alternatively, display system 100 may be utilized in and/or in conjunction with any suitable electronic display device, such as, for example, a television, a computer monitor, a laptop monitor, a tablet device, a portable device, such as a cellular telephone (e.g., a smartphone), a wrist-watch device, a pendant device or other wearable or miniature device, a media player, a camera viewfinder, a gaming device, a navigation device, and/or any other type of device including an electronic display, without limitation.

FIG. 2 is a perspective view of a head-mounted display system 200 in accordance with some embodiments. In some embodiments, head-mounted display system 200 may include a head-mounted-display device 202, a facial-interface system 208, a strap assembly 214, and audio subsystems 216. A head-mounted-display device may include any type or form of display device or system that is worn on or about a user's head and displays visual content to the user. Head-mounted-display devices may display content in any suitable manner, including via a display element (e.g., display panel 102). Head-mounted-display devices may display content in one or more of various media formats. For example, a head-mounted-display device may display video, photos, and/or computer-generated imagery (CGI). Head-mounted-display device 202 may include a display housing 210 surrounding various components of head-mounted-display device 202, including lenses 204 and 205 and various electronic components, including backlights and temperature sensors as described herein. Display housing 210 may include a housing back surface 212 and side surfaces surrounding the internal components, and an opening surrounding a viewing region 206 at a front side of display housing 210.

Head-mounted-display devices may provide diverse and distinctive user experiences. Some head-mounted-display devices may provide virtual-reality experiences (i.e., they may display computer-generated or pre-recorded content), while other head-mounted displays may provide real-world experiences (i.e., they may display live imagery from the physical world). Head-mounted displays may also provide any mixture of live and virtual content. For example, virtual content may be projected onto the physical world (e.g., via optical or video see-through), which may result in augmented reality or mixed reality experiences. Head-mounted-display devices may be configured to be mounted to a user's head in a number of ways. Some head-mounted-display devices may be incorporated into glasses or visors. Other head-mounted-display devices may be incorporated into helmets, hats, or other headwear.

In some embodiments, facial-interface system 208 may be configured to comfortably rest against a region of a user's face, including a region surrounding the user's eyes, when head-mounted display system 200 is worn by the user. In these embodiments, facial-interface system 208 may include an interface cushion that is configured to rest against portions of the user's face (e.g., at least a portion of the user's nasal, cheek, temple, and/or forehead facial regions). Facial-interface system 208 may surround viewing region 206, which includes the user's field of vision, allowing the user to look through lenses 204 and 205 of head-mounted-display device 202 without interference from outside light while the user is wearing head-mounted display system 200.

Figure 3:
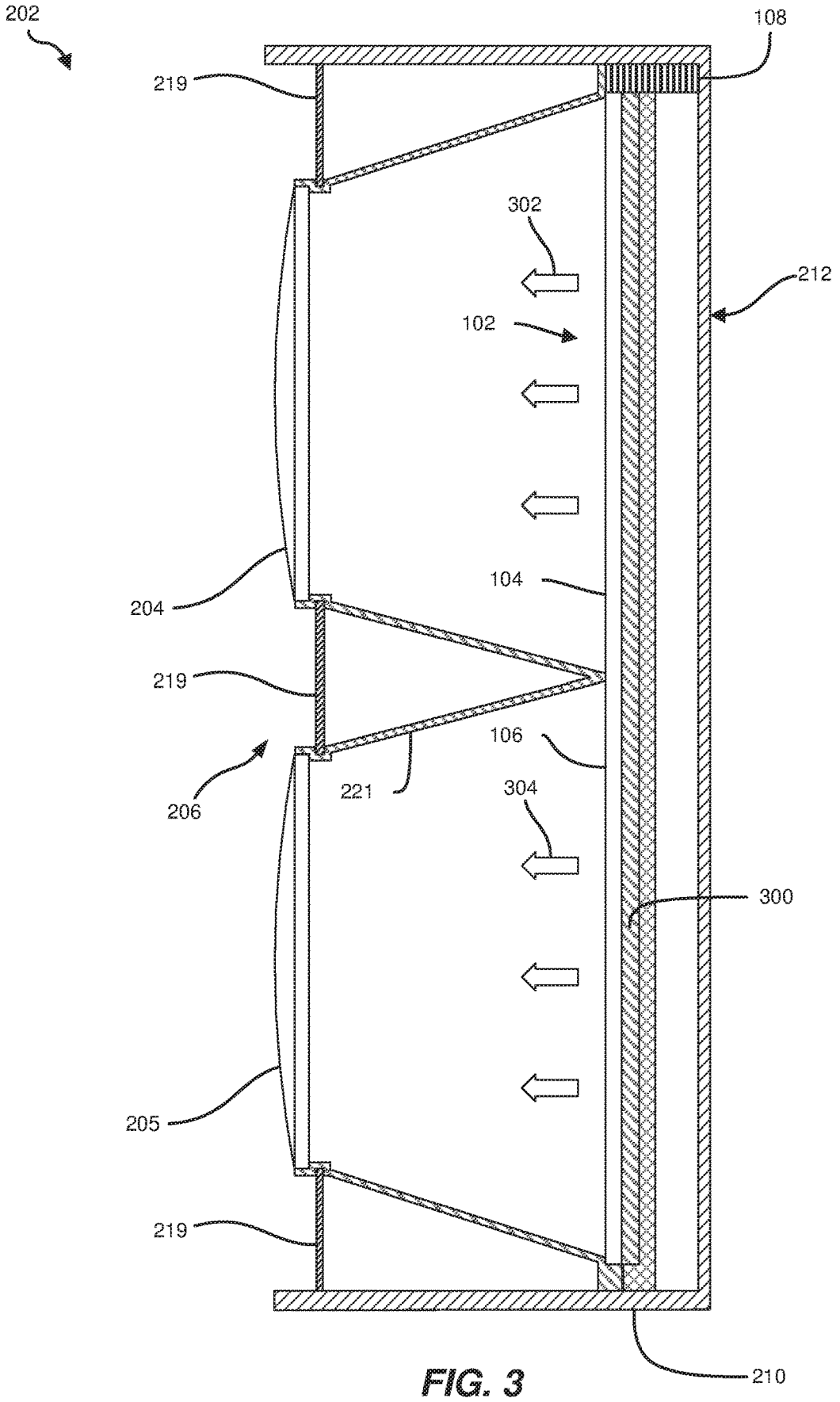
FIG. 3 is a cross-sectional top view of an exemplary head-mounted-display device in accordance with some embodiments.

FIG. 3 shows an exemplary cross-sectional top view of head-mounted-display device 202. As shown in this figure, display panel 102, a backlight unit 300, and display driver 108 may be disposed within display housing 210 of head-mounted-display device 202. Display panel 102 may be disposed within display housing 210 relative to lenses 204 and 205 such that images produced by a display region of display panel 102 are visible to a user through lenses 204 and 205. As shown, display panel 102 may be positioned and oriented in display housing 210 such that a front surface of display panel 102 faces towards lenses 204 and 205. As shown, backlight unit 300 may be positioned behind display panel 102. As such, light 302 emitted from the left portion of backlight unit 300 through left side 104 of display panel 102 may be visible to a user's left eye, and light 304 emitted from the right portion of backlight unit 300 through right side 106 of display panel 102 may be visible to the user's right eye.

Figure 4A:
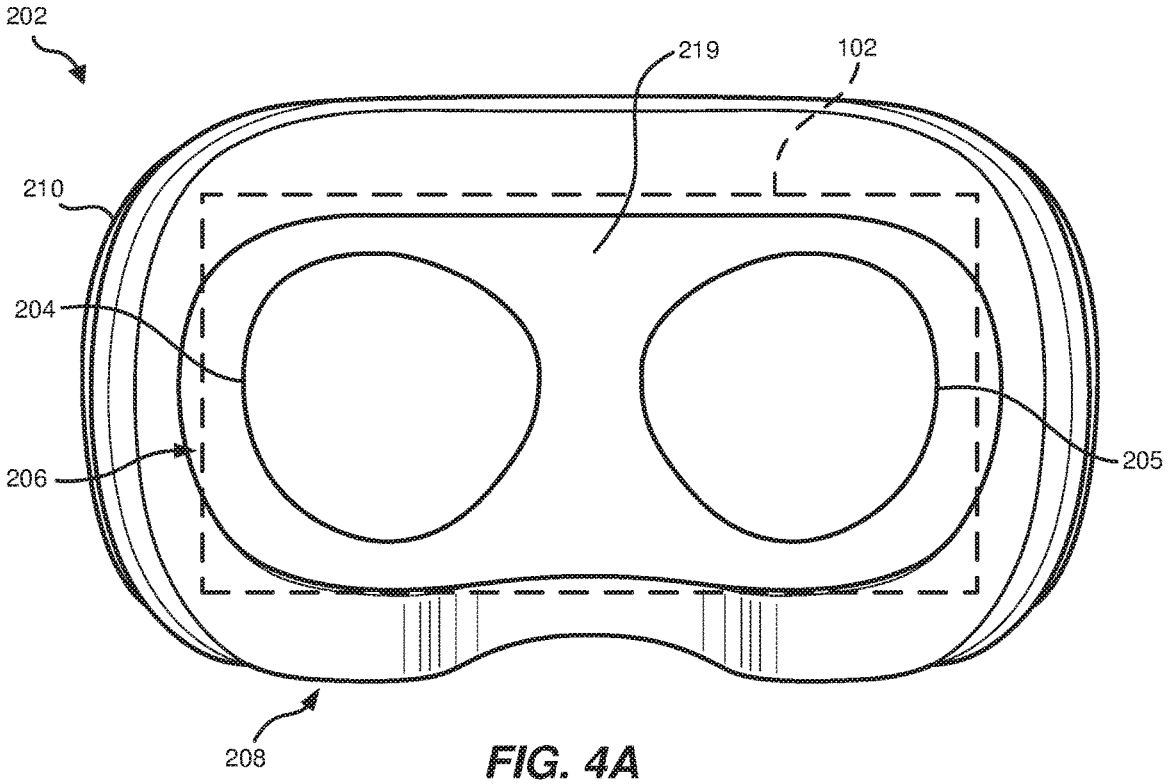
FIG. 4A is a front view of an exemplary head-mounted-display device in accordance with some embodiments.
Figure 4B:
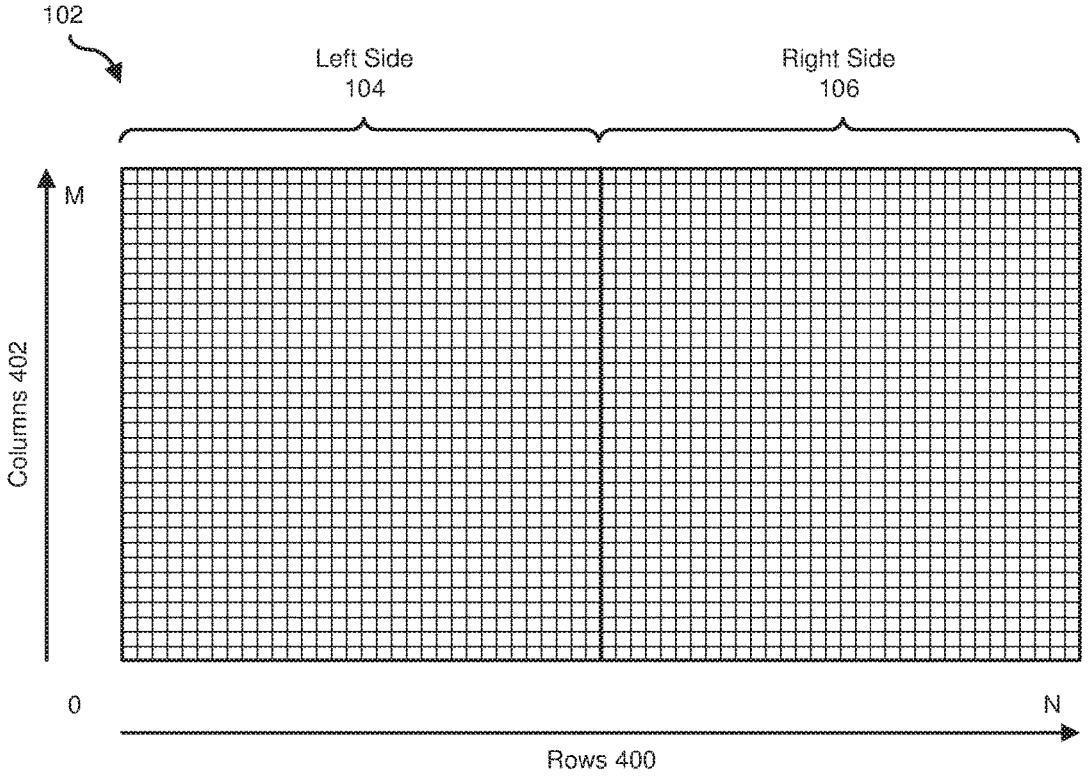
FIG. 4B is a front view of an exemplary display panel in accordance with some embodiments.

FIGS. 4A and 4B respectively show front views of head-mounted-display device 202 and display panel 102. As shown in FIG. 4A, head-mounted-display device 202 may include at least one display, such as display panel 102, disposed within display housing 210. In some embodiments, distinct portions of display panel 102 may be visible to each of a user's eyes, with portions visible to each eye being separated by a dividing region 221 (e.g., separate eye cups, a central partition, etc.) extending between lenses 204 and 205 and display panel 102. Such a configuration may enable distinct images to be presented by display panel 102 to each of the user's eyes, allowing for 3-dimensional images to be perceived by the user.

As shown in FIG. 4A, head-mounted-display device 202 may also include a light-blocking panel 219 surrounding lenses 204 and 205. Light-blocking panel 219 may, for example, extend between lenses 204 and 205 and surrounding portions of display housing 210. Light-blocking panel 219 may include, for example, a light-absorbing material (e.g., a dark polymeric and/or fabric material) that masks internal components of head-mounted-display device 202 and that prevents any outside light incidentally entering viewing region 206 (e.g., through a gap between the user's face and facial-interface system 208) from being reflected within viewing region 206. Display housing 210 may include a rigid material, such as a rigid plastic, that supports and protects internal components, such as display panel 102 and other electronics.

As shown in FIG. 4B, display panel 102 may include an M×N array of pixel elements (e.g., pixels and/or sub-pixels) that form visible images according to a suitable display technology (e.g., fast switching liquid crystal or OLED display technologies). As shown, display panel 102 may include M pixel-element columns 402 and N pixel-element rows 400. Each pixel element of display panel 102 may include material that changes states (i.e., orientations of liquid crystals) in response to applied currents or voltages. In some examples, frames may be displayed via display panel 102 by driving pixel elements at different currents and/or voltages such that the pixel elements take on different states and different amounts of light is emitted through each of the pixel elements. In some examples, a wide variety of visible colors may be produced by combining different amounts of light passed through sub-pixel color regions (e.g., red, green, and/or blue color regions).

In some embodiments, display driver 108 may display a frame via display panel 102 by sending corresponding input signals to each of rows 400 of display panel 102, with the input signals being sequentially scanned along rows 400 from row 0 to row N. These input signals may set material (e.g., liquid crystals or organic material) at each of rows 400 to new states suitable for displaying the frame. Display driver 108 may initiate an illumination of a portion of rows 400 after its material has completely transitioned to the new states as described below. While the examples described herein use row-based scanning and illumination techniques, the embodiments describe herein may additionally or alternatively be configured to use column-based scanning and illumination techniques.

Figure 5:
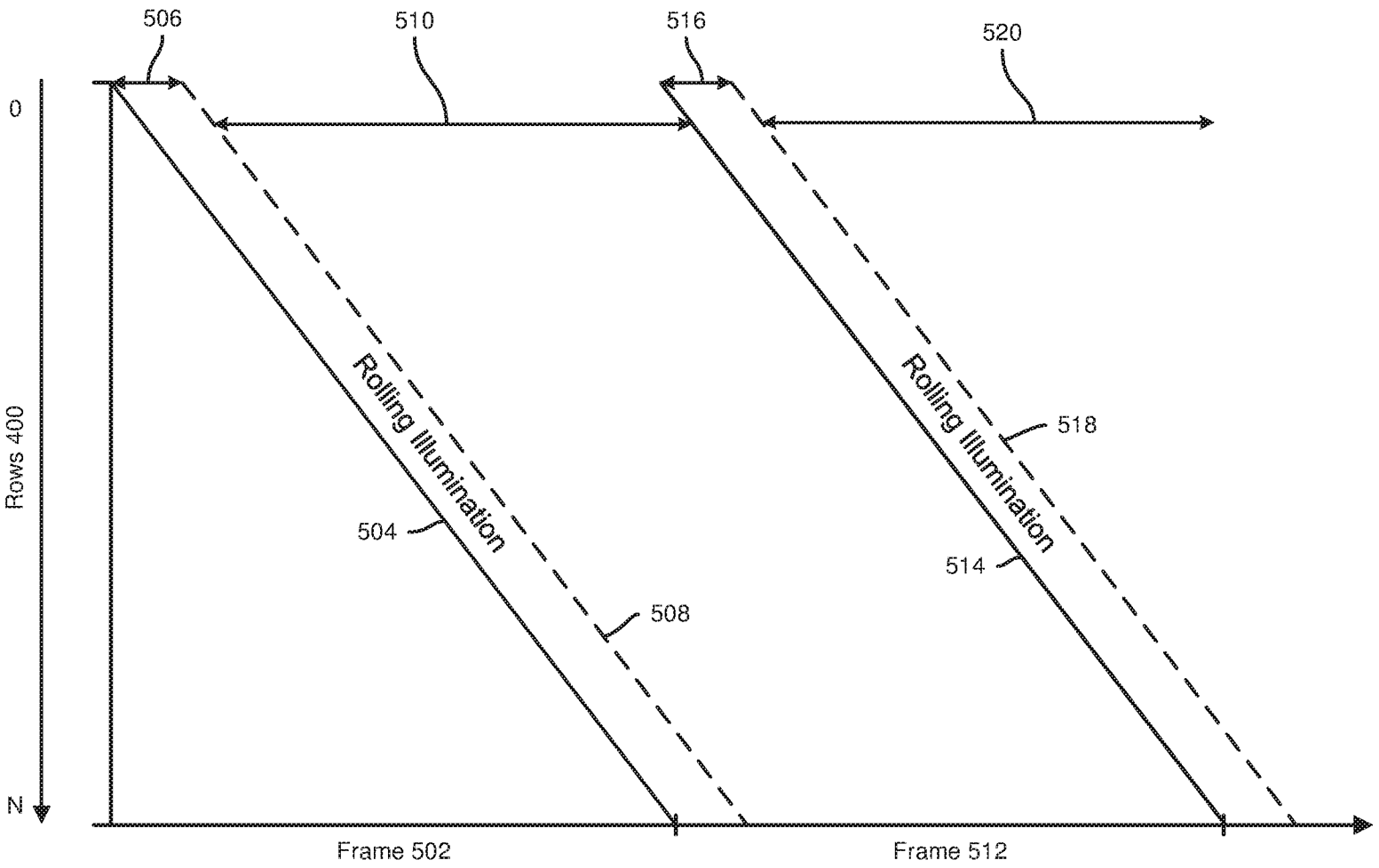
FIG. 5 is a timing diagram illustrating exemplary data scans and illumination periods of an exemplary organic light-emitting diode panel in accordance with some embodiments.

FIG. 5 illustrates how one or more of the apparatus or systems described herein may display frames via an active-matrix OLED display. As shown in FIG. 5, display driver 108 may display a frame during frame period 502 by scanning corresponding input signals 504 to rows 400 of display panel 102, with input signals 504 being sequentially scanned along rows 400 from row 0 to row N, prior to illuminating each of rows 400 during a period 506 of illumination. Since input signals 504 were sequentially scanned to rows 400, line marker 508 may indicate the time at which each of rows 400 stops being illuminated for a period 510 of no illumination. As shown in FIG. 5, display driver 108 may display an additional frame during a subsequent frame period 512 by sending corresponding input signals 514 to each of rows 400 of display panel 102 prior to illuminating each of rows 400 during a period 516 of illumination. Since input signals 514 were sequentially scanned to rows 400, line marker 518 may indicate the time at which each of rows 400 stops being illuminated for a period 520 of no illumination.

Figure 6:
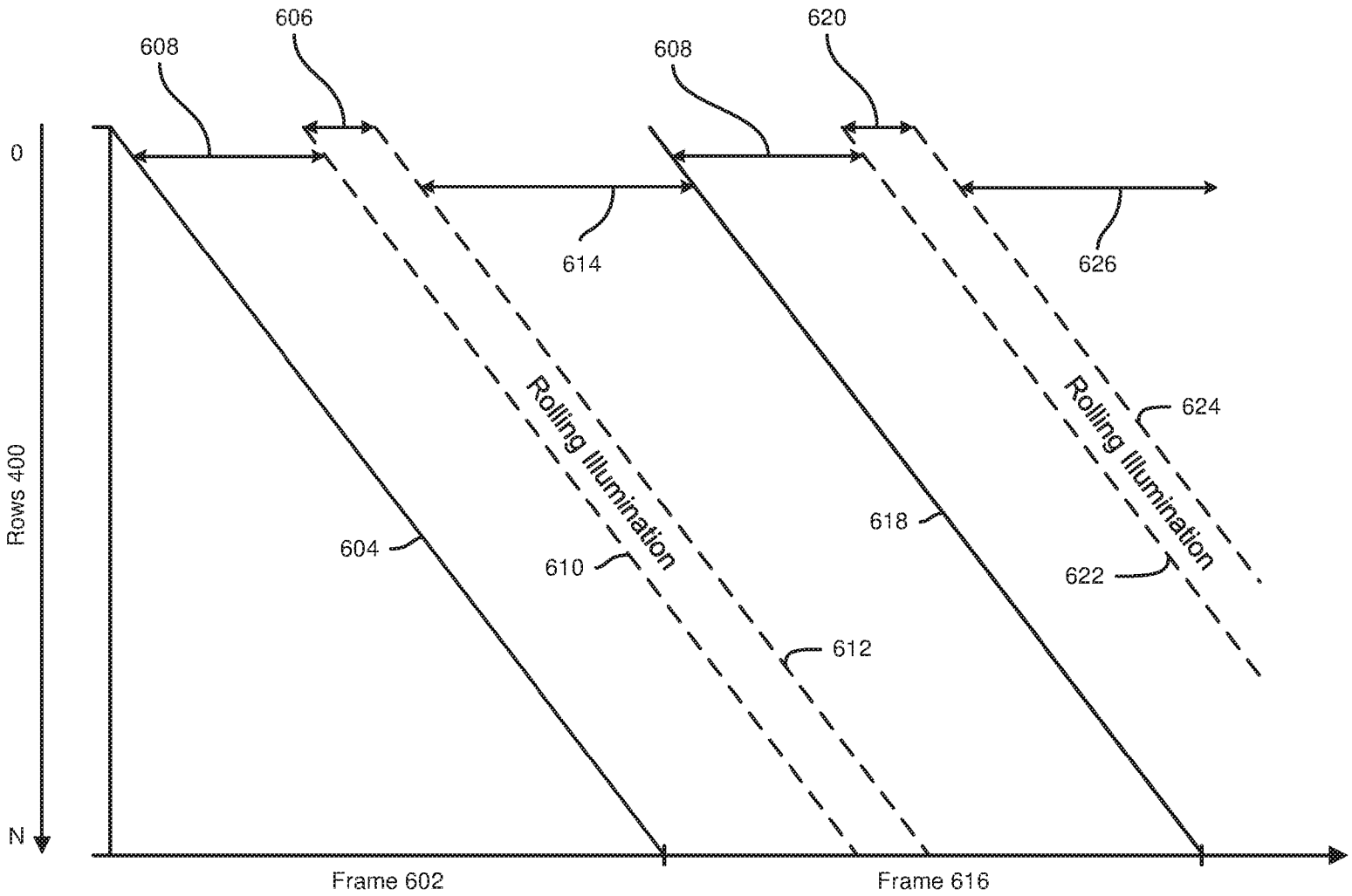
FIG. 6 is a timing diagram illustrating exemplary data scans, liquid-crystal transitions, and illumination periods of an exemplary liquid crystal panel in accordance with some embodiments.

FIG. 6 illustrates how one or more of the apparatus or systems described herein may display frames via a liquid crystal display. As shown in FIG. 6, display driver 108 may display a frame during frame period 602 by scanning corresponding input signals 604 to rows 400 of display panel 102, with input signals 604 being sequentially scanned along rows 400 from row 0 to row N, prior to initiating a rolling illumination of each of rows 400 during a period 606 of illumination. In this example, the time taken for LC material contained within display panel 102 to settle to its new state is represented by transition period 608. Since input signals 604 were sequentially scanned to rows 400, line marker 610 may indicate the time at which the LC material at each of rows 400 had settled into its new state and the time at which each of rows 400 had started to be illuminated for period 606. Since input signals 604 were sequentially scanned to rows 400, line marker 612 may indicate the time at which each of rows 400 stops being illuminated for a period 614 of no illumination.

As shown in FIG. 6, display driver 108 may display an additional frame during a subsequent frame period 616 by scanning corresponding input signals 618 to rows 400 of display panel 102 prior to initiating another rolling illumination of each of rows 400 during a period 620 of illumination. In this example, the time taken for LC material contained within display panel 102 to settle to its new state is represented by transition period 608. Since input signals 618 were sequentially scanned to rows 400, line marker 622 may indicate the time at which the LC material at each of rows 400 had settled into its new state and the time at which each of rows 400 had started to be illuminated for period 620. Since input signals 618 were sequentially scanned to rows 400, line marker 624 may indicate the time at which each of rows 400 stops being illuminated for a period 626 of no illumination.

Figure 7:
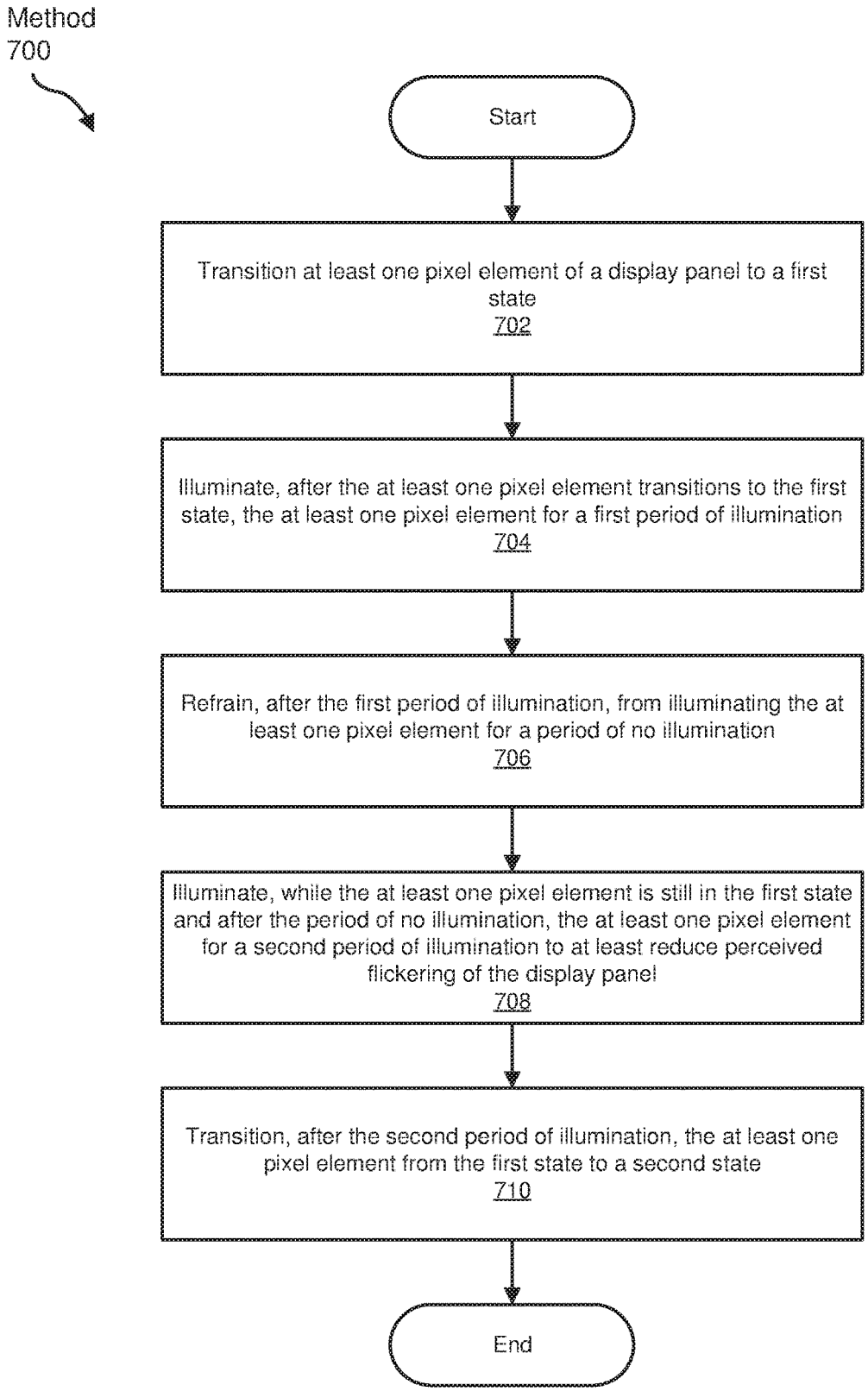
FIG. 7 is a flow diagram of an exemplary method for preventing display flicker.
Figure 8:
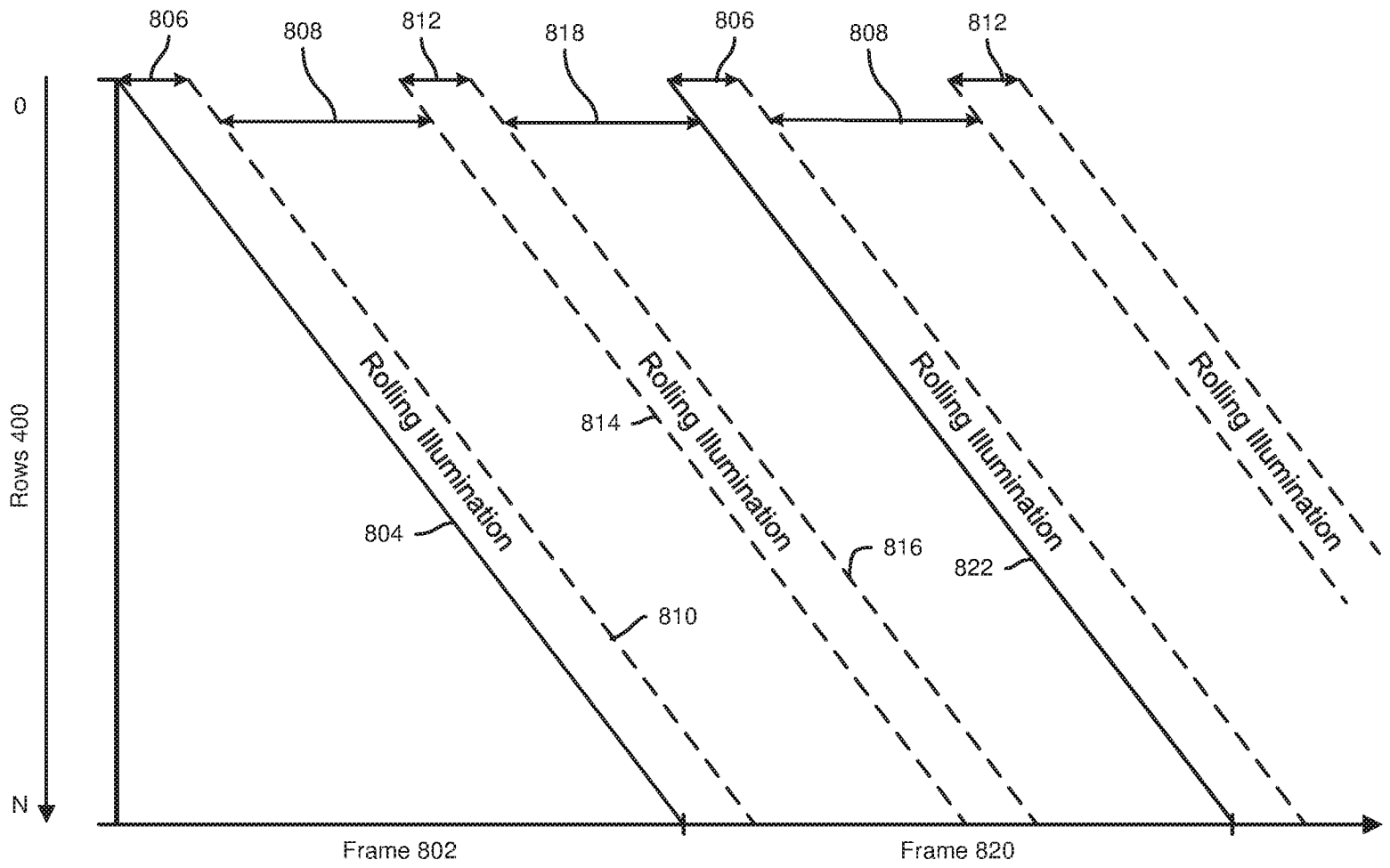
FIG. 8 is a timing diagram illustrating exemplary data scans and illumination periods of an exemplary organic light-emitting diode panel in accordance with some embodiments.
Figure 9:
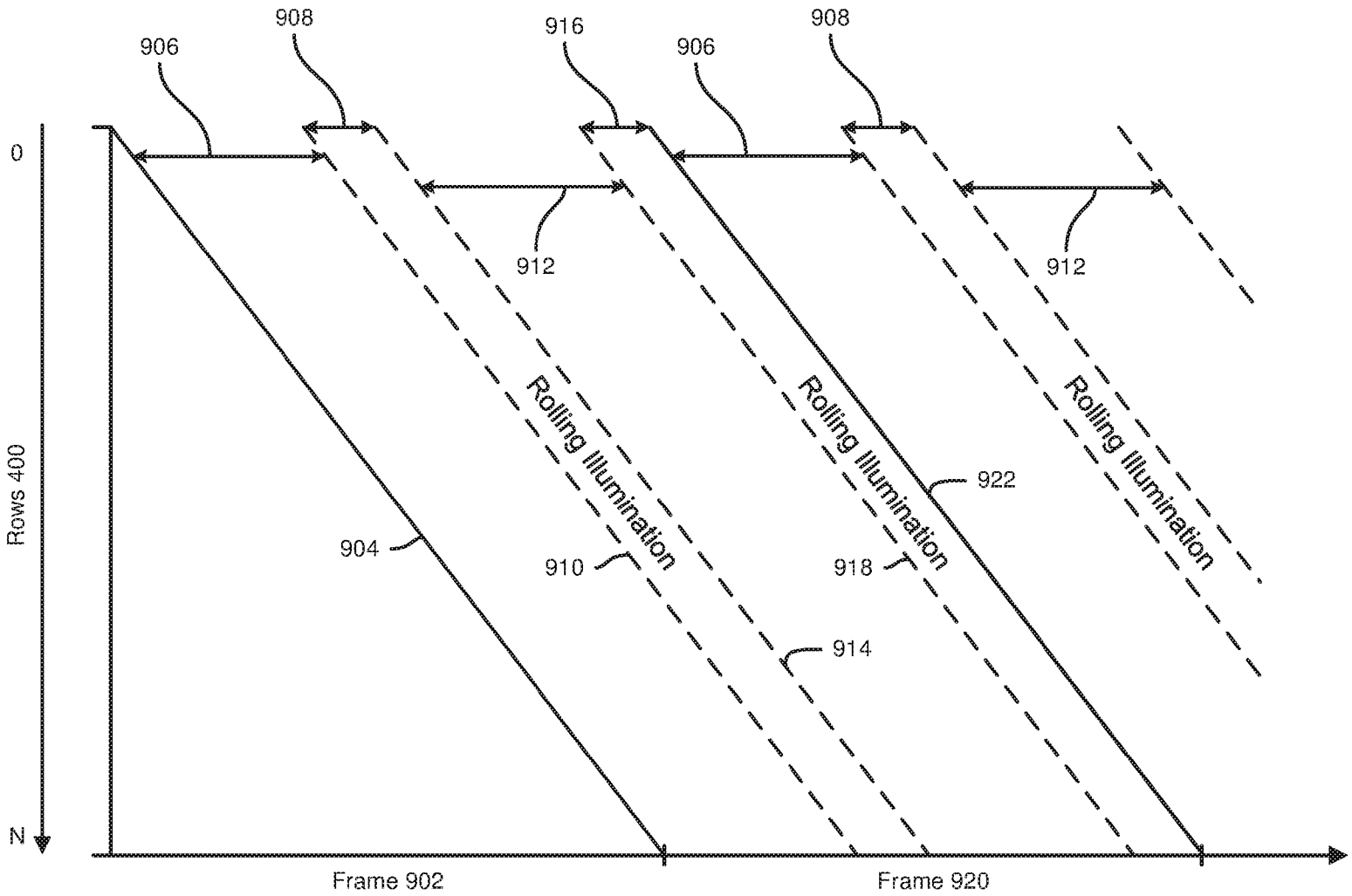
FIG. 9 is a timing diagram illustrating exemplary data scans, liquid-crystal transitions, and illumination periods of an exemplary liquid crystal panel in accordance with some embodiments.
Figure 10:
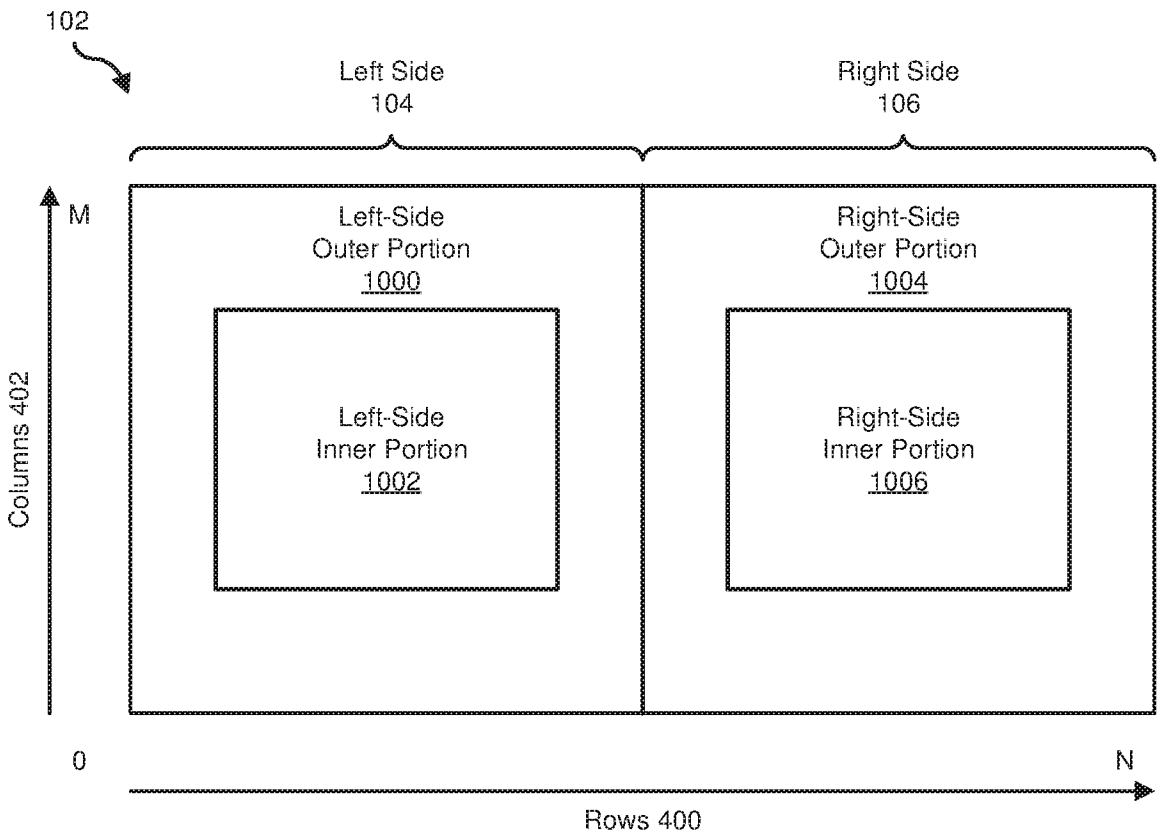
FIG. 10 is a front view of an exemplary display panel in accordance with some embodiments.
Figure 11:
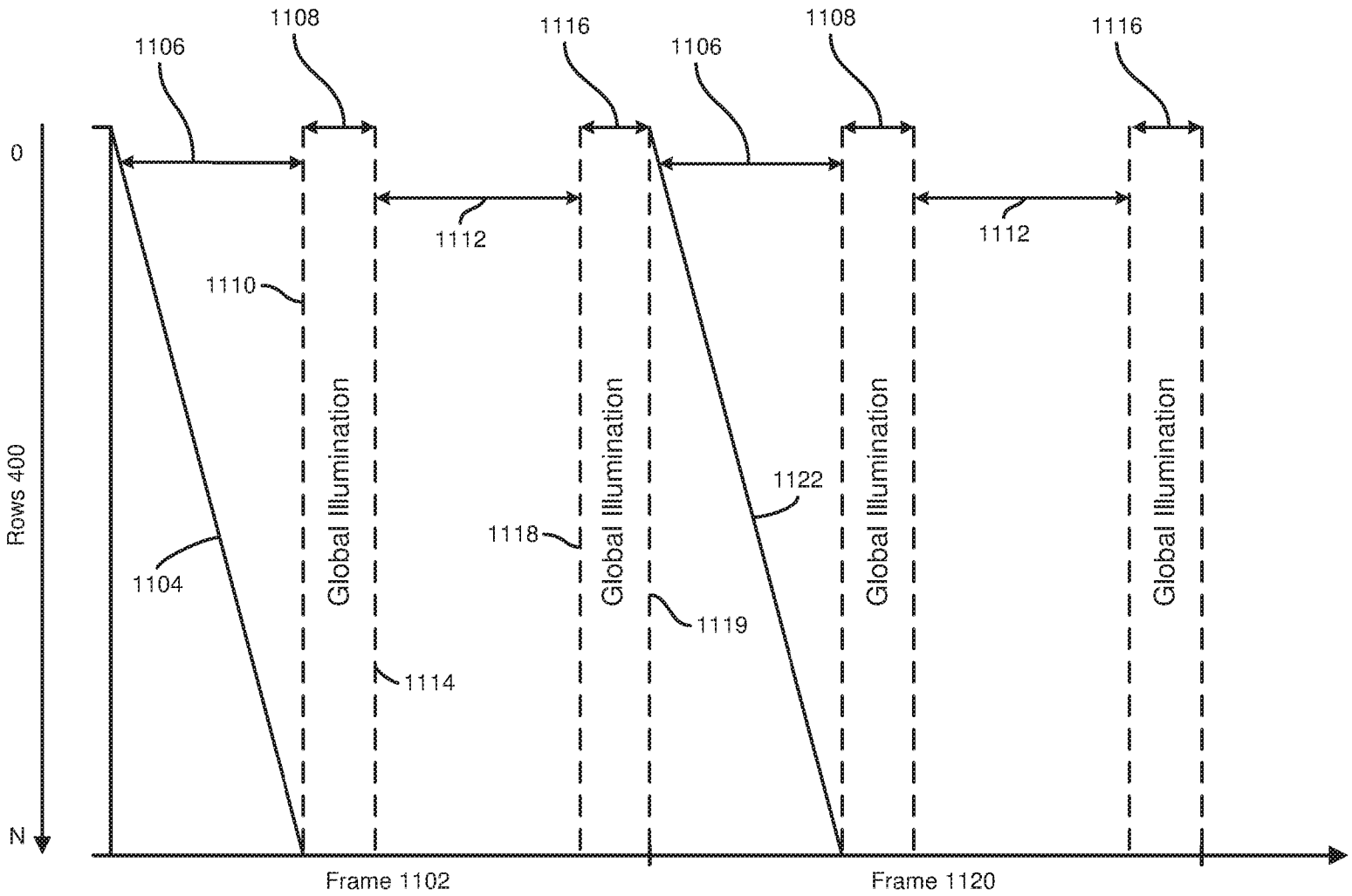
FIG. 11 is a timing diagram illustrating exemplary data scans and illumination periods of an exemplary organic light-emitting diode panel in accordance with some embodiments.

At high enough frame rates, the apparatus or systems described herein may display frames via display panel 102 as described in connection with FIGS. 5 and 6. At lower frame rates, the methods of illumination shown in these figures may result in noticeable display flickering. FIG. 7 is a flow diagram of an example computer-implemented method 700 for illuminating display panels in a way that prevents perceivable display flicker at lower frame rates, FIG. 8 illustrates how one or more of the apparatus or systems described herein may display frames via an active-matrix OLED display at lower frame rates to prevent display flicker, FIG. 9 illustrates how one or more of the apparatus or systems described herein may display frames via a liquid crystal display at lower frame rates to prevent display flicker, and FIG. 11 illustrates how one or more of the apparatus or systems described herein may display frames via a fast-scanning OLED display at lower frame rates to prevent display flicker. The steps shown in FIG. 7 may be performed by any suitable computer-executable code and/or computing system, including display system 100 in FIG. 1, head-mounted-display device 202 in FIG. 2, and/or variations or combinations of one or more of the same. In one example, each of the steps shown in FIG. 7 may represent an algorithm whose structure includes and/or is represented by multiple sub-steps, examples of which will be provided in greater detail below.

As illustrated in FIG. 7, at step 702, one or more of the apparatus or systems described herein may transition at least one pixel element of a display panel to a first state. The apparatus or systems described herein may transition pixel elements of a display panel to states suitable for displaying a frame as part of displaying a sequence of frames via the display screen at a particular frame rate. For example, as shown in FIG. 8, data module 110 may initiate the display of a first frame during frame period 802 by scanning corresponding input signals 804 to rows 400 of display panel 102, with input signals 804 being sequentially scanned along rows 400 from row 0 to row N. By scanning input signals 804 to rows 400 of display panel 102, data module 110 may cause organic material of display panel 102 to transition to states suitable for displaying the first frame.

In another example, as shown in FIG. 9, data module 110 may initiate the display of a first frame during frame period 902 by scanning corresponding input signals 904 to rows 400 of display panel 102, with input signals 904 being sequentially scanned along rows 400 from row 0 to row N. By scanning input signals 904 to rows 400 of display panel 102, data module 110 may cause LC material of display panel 102 to transition to states suitable for displaying the first frame. In this example, the time taken for LC material contained within display panel 102 to settle to its new state is represented by transition period 906. Since input signals 904 were sequentially scanned to rows 400, the line marker associated with period 908 may indicate the time at which the LC material at each of rows 400 had settled into its new state.

In the example shown in FIG. 11, data module 110 may initiate the display of a first frame during frame period 1102 by scanning corresponding input signals 1104 to rows 400 of display panel 102, with input signals 1104 being sequentially scanned along rows 400 from row 0 to row N. By scanning input signals 1104 to rows 400 of display panel 102, data module 110 may cause organic material of display panel 102 to transition to states suitable for displaying the first frame.

At step 704, one or more of the apparatus or systems described herein may illuminate, after the at least one pixel element transitions to the first state, the at least one pixel element for a first period of illumination. In some examples, illumination module 112 may illuminate each pixel element of a display panel as soon as the pixel element has completely transitioned into a new state and/or as part of transitioning the pixel element. For example, as shown in FIG. 8, illumination module 112 may illuminate each of rows 400 for a period 806 of illumination as part of scanning frame data to each of rows 400. In another example, as shown in FIG. 9, illuminating module 112 may initiate a rolling illumination of each of rows 400 for a period 908 of illumination. In this example, the time taken for LC material contained within display panel 102 to settle to its new state is represented by transition period 906. Since input signals 904 were sequentially scanned to rows 400, line marker 910 may indicate the time at which the LC material at each of rows 400 had settled into its new state and the time at which each of rows 400 had started to be illuminated for period 908. In the example shown in FIG. 11, illuminating module 112 may initiate a global illumination (e.g., an instantaneous illumination) of rows 400 for a period 1108 of illumination. In this example, illuminating module 112 may initiate the global illumination a period 1106 after the start of frame 1102 or at any time after all rows have been scanned to, and line marker 1110 may indicate the time at which each of rows 400 had started to be illuminated for period 1108.

At step 706, one or more of the apparatus or systems described herein may refrain, after the first period of illumination, from illuminating the at least one pixel element for a period of no illumination. For example, as shown in FIG. 8, illumination module 112 may refrain from illuminating rows 400 of display panel 102 for a period 808 of no illumination. Since input signals 804 were sequentially scanned to rows 400, line marker 810 may indicate the time at which each of rows 400 stops being illuminated for period 808 of no illumination. In another example, as shown in FIG. 9, illumination module 112 may refrain from illuminating rows 400 of display panel 102 for a period 912 of no illumination. Since input signals 904 were sequentially scanned to rows 400, line marker 914 may indicate the time at which each of rows 400 stops being illuminated for period 912 of no illumination. In the example shown in FIG. 11, illumination module 112 may refrain from illuminating rows 400 of display panel 102 for a period 1112 of no illumination. In this example, line marker 1114 may indicate the time at which each of rows 400 stops being illuminated.

At step 708, one or more of the apparatus or systems described herein may illuminate, while the at least one pixel element is still in the first state and after the period of no illumination, the at least one pixel element for a second period of illumination to at least reduce perceived flickering of the display panel. The apparatus or systems described herein may prevent a viewer from perceiving a flickering of a display panel by illuminating the display panel more than once during a frame period if illumination of the display panel at the current frame rate (e.g., as described in connection with FIGS. 5 and 6) would result in perceived display flicker. For example, as shown in FIG. 8, illumination module 112 may illuminate each of rows 400 for a period 812. Since input signals 804 were sequentially scanned to rows 400, line marker 814 may indicate the time at which each of rows 400 starts being illuminated for period 812 of illumination, and line marker 816 may indicate the time at which each of rows 400 stops being illuminated after period 812 of illumination. In this example, period 812 of illumination may be followed by an additional period 818 of no illumination. In another example, as shown in FIG. 9, illuminating module 112 may initiate a rolling illumination of each of rows 400 for a period 916 of illumination. Since input signals 904 were sequentially scanned to rows 400, line marker 918 may indicate the time at which each of rows 400 starts being illuminated for period 916 of illumination. In the example shown in FIG. 11, illuminating module 112 may initiate a global illumination of rows 400 for a period 1116 of illumination. In this example, line marker 1118 may indicate the time at which the global illumination starts, and line marker 1119 may indicate the time at which the global illumination ends.

Returning to FIG. 7, illuminating module 112 may monitor the frame rate at which a display panel is receiving frames to ensure that the display panel is illuminated at or above an illumination rate known to reduce or illuminate display flickering (e.g., an illumination rate of 120 hertz). For example, illumination module 112 may prevent a viewer from perceiving a flickering of a display panel that is receiving frames at a 60 hertz frame rate by ensuring that the display panel is illuminated twice per frame. In another example, illumination module 112 may prevent a viewer from perceiving a flickering of a display panel that is receiving frames at a 30 hertz frame rate by ensuring that the display panel is illuminated four times per frame period.

In some examples, illumination module 112 may illuminate a display panel at regular intervals or irregular intervals. In at least one example, illumination module 112 may illuminate a display panel such that periods of illumination and periods of no illumination are evenly spaced within a frame period. For example, if illumination module 112 illuminates a display panel for two periods of illumination per frame period, illumination module 112 may initiate the second period of illumination one half of the frame period after the start of the first period of illumination. Similarly, if illumination module 112 illuminates a display panel for three periods of illumination per frame period, illumination module 112 may initiate the second period of illumination one third of the frame period after the start of the first period of illumination and may initiate the third period of illumination one third of the frame period after the start of the second period of illumination.

In some examples, illumination module 112 may illuminate different portions of a display panel at different rates to prevent a user from perceiving display flicker. As mentioned above, display flicker may be more easily perceptible at the peripheral of the human visual field. For at least this reason, illumination module 112 may illuminate outer portions of a display panel more often than inner portions. Using FIG. 10 to illustrate, illumination module 112 may illuminate left-side outer portion 1000 and right-side outer portion 1004 of display panel 102 more often than left-side inner portion 1002 and right-side inner portion 1006. In some examples, illumination module 112 may prevent a user from perceiving display flicker by ensuring that each portion of a display panel is illuminated at or above an illumination rate known to reduce or eliminate perceived display flickering at each portion.

At step 710, one or more of the apparatus or systems described herein may transition, after the second period of illumination, the at least one pixel element from the first state to a second state. For example, as shown in FIG. 8, display driver 108 may display an additional frame during a subsequent frame period 820 by sending corresponding input signals 822 to each of rows 400 of display panel 102. The apparatus or systems described herein may illuminate the additional frame in the manner described above. In another example, as shown in FIG. 9, display driver 108 may display an additional frame during a subsequent frame period 920 by scanning corresponding input signals 922 to rows 400 of display panel 102. In the example shown in FIG. 11, display driver 108 may display an additional frame during a subsequent frame period 1120 by scanning corresponding input signals 1122 to rows 400 of display panel 102. The apparatus or systems described herein may illuminate the additional frame in the manner described above.

As discussed throughout the instant disclosure, the disclosed apparatuses, systems, and methods may provide one or more advantages over traditional display apparatuses, systems, and methods. For example, embodiments of the instant disclosure may prevent a viewer from perceiving display flicker by illuminating display panels at a sufficiently high rate regardless of the frame rate at which frames are received and displayed via the display panels. In some examples, multiple illumination periods or pulses may be used for each displayed frame to prevent flickering. By decoupling illumination rates from frame rates, embodiments of the instant disclosure may enable the use of lower frame rates for display systems where viewers may be more prone to perceiving display flicker (e.g., virtual and augmented reality headsets). Moreover, by enabling the use of lower frame rates for certain display systems, embodiments of the instant disclosure may reduce the cost of these systems since they may require less compute, power, and bandwidth resources.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive frame data to be displayed to a user via a display panel, transform the frame data into two or more distinct displays of the frame data by illuminating the frame data two separate and distinct times, output a result of the transformation via the display panel, use the result of the transformation to prevent the user from noticing flickering of the display panel when viewing the frame data. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

Embodiments of the instant disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

What is claimed is:

1. A display device comprising:

a display panel comprising at least one pixel element; and a display driver configured to:

transition the at least one pixel element to a first state;

illuminate, after the at least one pixel element transitions to the first state, the at least one pixel element for a first period of illumination;

refrain, after the first period of illumination, from illuminating the at least one pixel element for a period of no illumination;

illuminate, while the at least one pixel element is still in the first state and after the period of no illumination, the at least one pixel element for a second period of illumination to at least reduce perceived flickering of the display panel; and transition, after the second period of illumination, the at least one pixel element from the first state to a second state.

2. The display device of claim 1, wherein the at least one pixel element comprises a row of pixel elements of the display panel.

3. The display device of claim 1, wherein the display driver is further configured to:

refrain, after the second period of illumination, from illuminating the at least one pixel element for one or more additional periods of no illumination; and illuminate, while the at least one pixel element is still in the first state and after each of the one or more additional periods of no illumination, the at least one pixel element for an additional period of illumination.

4. The display device of claim 1, wherein:

the at least one pixel element is in an outer portion of the display panel;

the display panel further comprises at least one additional pixel element that is in an inner portion of the display panel; and the display driver is further configured to:

transition the at least one additional pixel element to a third state;

transition, after a frame period, the at least one additional pixel element from the third state to a fourth state; and illuminate the at least one additional pixel element only once during the frame period.

5. The display device of claim 1, wherein:

the display driver is configured to transition the at least one pixel element from the first state to the second state at a frame period after transitioning the at least one pixel element to the first state; and the display driver is configured to illuminate the at least one pixel element for the second period of illumination at substantially one half of the frame period after the start of the first period of illumination.

6. The display device of claim 1, wherein:

the display driver is configured to transition the at least one pixel element from the first state to the second state at a frame period after transitioning the at least one pixel element to the first state;

the first period of illumination is less than twenty percent of the frame period; and the second period of illumination is less than twenty percent of the frame period.

7. The display device of claim 1, wherein the first period of illumination and the second period of illumination are substantially the same length.

8. The display device of claim 1, wherein the display panel comprises an organic light-emitting diode panel.

9. The display device of claim 1, wherein the display panel comprises a liquid crystal display panel.

10. The display device of claim 9, wherein the display device further comprises a backlight unit configured to perform rolling illumination.

11. The display device of claim 1, wherein:

the display driver simultaneously illuminates all pixel elements of the display panel for the first period of illumination; and the display driver simultaneously illuminates all pixel elements of the display panel for the second period of illumination.

12. The display device of claim 1, wherein:

the display panel further comprises at least one additional pixel element; and the display driver is further configured to:

transition, during the first period of illumination of the at least one pixel element, the at least one additional pixel element to a third state;

illuminate, after the at least one additional pixel element transitions to the third state, the at least one additional pixel element for a third period of illumination;

refrain, after the third period of illumination, from illuminating the at least one additional pixel element for an additional period of no illumination;

illuminate, while the at least one additional pixel element is still in the third state and after the additional period of no illumination, the at least one additional pixel element for a fourth period of illumination to at least reduce perceived flickering of the display panel; and transition, after the fourth period of illumination, the at least one additional pixel element from the third state to a fourth state.

13. The display device of claim 1, wherein:

the display device is a head-mounted display;

the head-mounted display further comprises a display housing configured to be mounted on a user's head; and the display panel and the display driver are disposed within the display housing.

14. The display device of claim 13, wherein the head-mounted display further comprises:

a lens for the user's eye, the lens being disposed within the display housing;

an additional lens for the user's other eye, the additional lens being disposed within the display housing; and an additional display panel disposed within the display housing, the additional display panel comprising at least one additional pixel element; wherein:

the display panel is configured to provide images to the user's eye through the lens;

the additional display panel is configured to provide additional images to the user's other eye through the additional lens; and the display driver is further configured to:

transition the at least one additional pixel element to a third state;

illuminate, after the at least one additional pixel element transitions to the third state, the at least one additional pixel element for a third period of illumination;

refrain, after the third period of illumination, from illuminating the at least one additional pixel element for an additional period of no illumination;

illuminate, while the at least one additional pixel element is still in the third state and after the additional period of no illumination, the at least one additional pixel element for a fourth period of illumination to at least reduce perceived flickering of the additional display panel; and transition, after the fourth period of illumination, the at least one additional pixel element from the third state to a fourth state.

15. The display device of claim 1, wherein:

the display driver transitions the at least one pixel element to the first state by applying a first readout signal to the at least one pixel element;

the first readout signal causes the at least one pixel element to take on the first state;

the display driver transitions the at least one pixel element to the second state by applying a second readout signal to the at least one pixel element; and the second readout signal causes the at least one pixel element to take on the second state.

16. A computer-implemented method comprising:

transitioning at least one pixel element of a display panel to a first state;

illuminating, after the at least one pixel element transitions to the first state, the at least one pixel element for a first period of illumination;

refraining, after the first period of illumination, from illuminating the at least one pixel element for a period of no illumination;

illuminating, while the at least one pixel element is still in the first state and after the period of no illumination, the at least one pixel element for a second period of illumination to at least reduce perceived flickering of the display panel; and transitioning, after the second period of illumination, the at least one pixel element from the first state to a second state.

17. The computer-implemented method of claim 16, wherein a rolling-illumination method is used to illuminate the at least one pixel element for the first period of illumination and the second period of illumination.

18. The computer-implemented method of claim 16, wherein a global-illumination method is used to illuminate the at least one pixel element for the first period of illumination and the second period of illumination.

19. The computer-implemented method of claim 16, wherein:

transitioning the at least one pixel element to the first state comprises applying a first readout signal to the at least one pixel element;

the first readout signal causes the at least one pixel element to take on the first state;

transitioning the at least one pixel element to the second state comprises applying a second readout signal to the at least one pixel element; and the second readout signal causes the at least one pixel element to take on the second state.

20. A non-transitory computer-readable medium comprising one or more computer-executable instructions that, when executed by at least one processor of a computing device, cause the computing device to:

transition at least one pixel element of a display panel to a first state;

illuminate, after the at least one pixel element transitions to the first state, the at least one pixel element for a first period of illumination;

refrain, after the first period of illumination, from illuminating the at least one pixel element for a period of no illumination;

illuminate, while the at least one pixel element is still in the first state and after the period of no illumination, the at least one pixel element for a second period of illumination to at least reduce perceived flickering of the display panel; and transition, after the second period of illumination, the at least one pixel element from the first state to a second state.

* * * * *